US006440499B1

(12) United States Patent
Wydra et al.

(10) Patent No.: US 6,440,499 B1
(45) Date of Patent: Aug. 27, 2002

(54) METHOD FOR PRODUCING A SLIP LAYER WHICH IS RESISTANT TO CORROSION AND OXIDATION

(75) Inventors: Gerhard Wydra, Oberschleissheim; Thomas Cosack, Taufkirchen; Wolfgang Hinreiner, Weilheim/Teck, all of (DE)

(73) Assignee: MTU Aero Engines GmbH, Munich (DE)

( * ) Notice: Subject to any disclaimer, the term of this patent is extended or adjusted under 35 U.S.C. 154(b) by 0 days.

(21) Appl. No.: 09/622,877

(22) PCT Filed: Feb. 22, 1999

(86) PCT No.: PCT/DE99/00476

§ 371 (c)(1),
(2), (4) Date: Sep. 8, 2000

(87) PCT Pub. No.: WO99/42633

PCT Pub. Date: Aug. 26, 1999

(30) Foreign Application Priority Data

Feb. 23, 1998 (DE) ..... 198 07 636

(51) Int. Cl.[7] ..... B05D 1/02; B05D 3/02; B05D 1/29; B05D 1/18

(52) U.S. Cl. ..... 427/376.8; 427/380; 427/383.7; 427/295; 427/427; 427/429; 427/436

(58) Field of Search ..... 427/376.6, 376.7, 427/376.8, 380, 383.7, 295, 427, 429, 436

(56) References Cited

U.S. PATENT DOCUMENTS

| | | | | | |
|---|---|---|---|---|---|
| 3,741,791 | A | * | 6/1973 | Maxwell et al. | 117/46 |
| 3,883,944 | A | | 5/1975 | Davis et al. | 29/460 |
| 4,034,142 | A | * | 7/1977 | Hecht | 428/678 |
| 5,795,659 | A | | 8/1998 | Meelu et al. | 428/610 |
| 6,036,995 | A | * | 3/2000 | Kircher et al. | 427/142 |
| 6,264,766 | B1 | * | 7/2001 | Ritter et al. | 148/525 |

FOREIGN PATENT DOCUMENTS

| | | | |
|---|---|---|---|
| EP | 0587341 | | 3/1994 |
| FR | 618485 | | 3/1927 |
| FR | 2115147 | | 7/1972 |
| GB | 1210026 | | 10/1970 |
| GB | 1318609 | | 5/1973 |
| JP | 55062158 | | 5/1980 |
| JP | 56093869 | | 7/1981 |
| SU | 602603 | | 3/1978 |
| WO | 8500305 | | 1/1985 |
| WO | WO94/07004 | * | 3/1994 |

OTHER PUBLICATIONS

Derwent's English Abstract of SU 602 6034, 070966 dated Mar. 13, 1978.

Patent Abstracts of Japan of JP 56093869 dated Jul. 29, 1981.

Patent Abstracts of Japan of JP 55062158 dated May 10, 1980.

* cited by examiner

*Primary Examiner*—Michael Barr
(74) *Attorney, Agent, or Firm*—Crowell & Moring LLP

(57) ABSTRACT

A method for producing a corrosion-resistant and an oxidation-resistant coating on a component in which a slurry is formed by mixing a binder solution with (1) a base powder selected from the group consisting of (a) MCrAlY wherein M is Ni or Co or both, (b) NiCrAl and (c) mixtures of (a) and (b) with (2) an added powder of Al, Pt, Pd, Si or mixtures thereof, each of the said powders having a grain size between 5 and 120 $\mu$m. The slurry is applied onto a component made of a superalloy based on nickel or cobalt. The slurry is hardened on the component to form a hardened slurry coating by heating the slurry to a temperature between room temperature and 450° C., and the hardened slurry coating is heated, to produce diffusion thereof into the component, at a temperature between 750° C. and 1250° C.

7 Claims, No Drawings

METHOD FOR PRODUCING A SLIP LAYER WHICH IS RESISTANT TO CORROSION AND OXIDATION

FIELD OF THE INVENTION

The invention relates to a method for producing a corrosion-resistant and oxidation-resistant coating on a component wherein the coating is formed from a slurry which is hardened and heat treated after application to the component.

BACKGROUND AND PRIOR ART

During operation of some components at high temperature, their exposed surfaces are subject to highly corrosive and oxidizing conditions. When used in gas turbines such components may, for example, be made from a superalloy having a nickel or cobalt base. For protection against corrosion, oxidation or erosion, the components are coated with layers made from metal powders.

U.S. Pat. No. 3,741,791 discloses a slurry coating of superalloy substrates, preferably made from Ni or Co base alloys. To improve corrosion and oxidation resistance, a slurry of Si powder and FeCrAlY powder is made, applied to the surface of the substrate, dried and finally heat treated at a temperature of approximately 1200° C.

FR 2,115,147 A discloses a coating method for substrates made from Ni or Co superalloys. To improve oxidation resistance, a binder is added to metal powder in the form of a disperse mixture with a particle size of preferably less than 38 $\mu$m, the composition is then applied to the substrates and subsequently heat treated. Disclosed metal powders are Co—Al, Ni—Al, and/or Fe—Al plus Cr—Al alloys which can be prealloyed with Y. Optionally, metal powders of Fe, Ni or Co can be admixed.

WO 9407004 A discloses the coating of substrates made of superalloys, in particular Ni base alloys, with a slurry. For improved hot-gas corrosion resistance, the slurry material comprising Al and Si or Cr and Al in a disperse mixture, is applied to the substrate, dried and heat treated at 850° C. to 1120° C. in an inert atmosphere or in a vacuum.

In a known method for producing a protective coating against corrosion and oxidation, first a metal powder is applied to a component by plasma spraying or the like. Then the coating is exposed to alitizing and finally blazed on. This method is associated with the disadvantages of involving many relatively expensive processing steps, principally the required plasma spraying.

SUMMARY OF THE INVENTION

It is thus an object of the invention to provide a method for producing a slurry coating of the type described above in which the method is as simple and cost-effective as possible.

According to the invention, this object is met by the method comprising the steps of forming a slurry by mixing a binder solution with (1) a base powder selected from the group consisting of (a) MCrAlY wherein M is at least one element selected from the group consisting of Ni and Co, (b) NiCrAl, and (c) mixtures of (a) and (b) with (2) an added powder selected from the group consisting of Al, Pt, Pd, Si and mixtures thereof, each of said powders having a grain size between 5 and 120 $\mu$m; applying said slurry onto a component made of a superalloy based on nickel or cobalt; hardening the slurry on the component to form a hardened slurry coating on said component by heating the slurry to a temperature between room temperature and 450° C.; and heat treating the hardened slurry coating to produce diffusion thereof into the component by heating the coated component at a temperature between 750° C. and 1250° C. whereby to form a corrosion-resistant and oxidation-resistant coating on said component.

The method according to the invention provides a substantial advantage in that admixing of added powder to the base powder results in an effect similar to that occurring, for example, during conventional alitizing of plasma-sprayed layers, except that the relatively expensive plasma spraying and the alitizing process are eliminated. The method according to the invention can be used both for producing protective coatings on new components and on repaired components.

It has been shown that resistance of the slurry coating to corrosion, oxidation and erosion, is significantly improved by diffusion processes between the base powder and the added powder or the added material.

DETAILED DESCRIPTION OF PREFERRED EMBODIMENTS

In an embodiment of the method according to the invention, the base powder comprises MCrAlY and/or NiCrAl, so that coatings with good corrosion protection properties can be produced with such metal powders.

If MCrAlY is used as the base powder, M is Ni or Co or both.

An added powder is mixed with the base powder, the added powder being Al, Pt, Pd, Si or mixtures thereof. The grain size distribution of both the base powder and the added powder ranges from 5 to 120 $\mu$m. The powder mixture is mixed with a binding solution to form a slurry.

The slurry is preferably applied to a superalloy component based on Ni or Co by brushing, spraying, dipping and draining or by other suitable methods. In comparison with plasma spraying, these methods result in significant cost advantages.

In an advantageous embodiment of the method, the slurry coating is heat treated for about 2 hours, preferably in a protective atmosphere, for example, in argon or in a vacuum.

Preferably the added powder is present in an amount up to 35% by weight of the total weight of base powder and added powder.

The invention is next described in more detail by means of a specific example.

EXAMPLE

In one embodiment of the method according to the invention the base powder is MCrAlY and the added powder is Al. In the MCrAlY constituent M denotes a mixture of Ni and Co. To produce the slurry material, 75% by weight of MCrAlY and 25% by weight of Al in relation to the total weight of base powder and added powder, are mixed.

Also admixed is an inorganic binder or a binder solution such as a 30% chrome phosphate solution.

To produce the slurry coating, the slurry material produced in this way is applied by brushing on a component which is to be protected against corrosion and oxidation, for example, a blade of a gas turbine. The component may for example be made of a superalloy based on nickel and cobalt. Due to the inorganic binder, hardening takes place at 350° C.

Finally, the slurry coating is heat treated at a temperature of 1060° C. in order to achieve diffusion of the slurry coating into the component. Heat treatment is effected for 2 hours in an argon atmosphere. Depending on the particular application, alternatively, heat treatment may also take place in a vacuum or in normal ambient atmosphere.

Although the invention has been described hereinabove with respect to specific embodiments thereof, it will become apparent to those skilled in the art that numerous modifications and variations can be made within the scope of the present invention as defined in the attached claims.

What is claimed is:

1. A method for producing a corrosion resistant and an oxidation-resistant coating on a component, said method comprising:

forming a slurry by mixing a binder solution with (1) a base powder selected from the group consisting of (a) MCrAlY, wherein M is at least one element selected from the group consisting of Ni and Co, (b) NiCrAl and (c) mixtures of (a) and (b), and (2) an added powder of Al or Al and one or more elements selected from the group consisting of Pt, Pd, and Si, said base and added powders having a grain size between 5 and 120 $\mu$m;

applying said slurry onto a component made of a superalloy based on nickel or cobalt;

hardening the slurry on the component to form a hardened slurry coating by heating the slurry to a temperature between room temperature and 450° C.; and heat treating the hardened slurry coating to produce diffusion thereof into the component by heating the coated component at a temperature between 750° C. and 1250° C., thereby forming a corrosion-resistant and oxidation-resistant coating on said component.

2. The method according to claim 1, wherein the applying of the slurry is effected by brushing, spraying or by dipping and draining.

3. The method according to claim 1, wherein the heat treating is carried out in vacuum or argon.

4. The method according to claim 1 wherein the heat treating step is carried out for 2 hours.

5. The method according to claim 1, wherein said binder solution is inorganic.

6. The method according to claim 1 wherein said added powder is present in an amount of up to 35% by weight of the total weight of the base powder and added powder.

7. The method according to claim 1, wherein said added powder consists of aluminum which is present in the amount of 25% by weight of the total amount of base powder and added powder.

* * * * *